United States Patent [19]

Kurosaki

[11] Patent Number: 4,779,906

[45] Date of Patent: Oct. 25, 1988

[54] LATCH DEVICE

[75] Inventor: Mutsuo Kurosaki, Yokohama, Japan

[73] Assignee: Nifco Inc., Yokohama, Japan

[21] Appl. No.: 72,743

[22] Filed: Jul. 13, 1987

[30] Foreign Application Priority Data

Jul. 11, 1986 [JP] Japan ..... 61-105625[U]

[51] Int. Cl.[4] ..... E05C 19/02

[52] U.S. Cl. ..... 292/19; 292/DIG. 4

[58] Field of Search ..... 292/19, 68, 153, DIG. 4

[56] References Cited

U.S. PATENT DOCUMENTS 4,331,355 5/1982 Okuno ..... 292/DIG. 4 X
4,616,861 10/1986 Kurosaki ..... 292/6
4,657,291 4/1987 Kurosaki ..... 292/DIG. 4 X

FOREIGN PATENT DOCUMENTS 58-148160 10/1983 Japan .
60-11977 1/1985 Japan ..... 292/DIG. 4
2060761 5/1981 United Kingdom .

*Primary Examiner*—Richard E. Moore
*Attorney, Agent, or Firm*—Oblon, Fisher, Spivak, McClelland & Maier

[57] ABSTRACT

A latch device has a rotary cam axially supported by one of a stationary cylinder and a sliding rod which effect relative reciprocal movement. The cam has reverse rotation preventing means and is engaged in the course of its rotation by associated portions provided on the other of the stationary cylinder and the sliding rod to temporarily restrict the movement of the sliding rod in one direction during the relative reciprocal movement.

6 Claims, 6 Drawing Sheets

LATCH DEVICE

BACKGROUND OF THE INVENTION

1. Field of the Invention

This invention relates to a latch device and more particularly to a relief type latch device in which, for example, a hingedly attached door can be locked in its closed position and the locked door can be opened by once slightly pushing it in the closing direction by the hand and then removing the hand therefrom.

2. Description of the Prior Art

Many latch devices for retaining the closed state of a door of an audio device, etc. have been proposed, in which there are provided a stationary cylinder and a sliding rod which are relatively movable with respect to each other, and a cam axially supported on the sliding rod is rotated during the reciprocal movement of the sliding rod to restrict the movement of the sliding rod in the vicinity of one end portion of the reciprocal movement (Japanese Utility Model Public Disclosures Nos. SHO 58-148160 and 60-11977, U.S. Pat. No. 4,616,861, British Pat. No. 2,060,761, U.S. patent application Ser. No. 877,710, etc.).

A latch device disclosed in the above-mentioned Japanese Utility Model Public Disclosures Nos. SHO 58-148160 and 60-11977 include a stationary cylinder having a hollow interior with one end open, a sliding rod having an inserting portion which is slidable within the stationary cylinder, and a spring means which is biased when the inserting portion is inserted into the stationary cylinder. The inserting portion is provided with a rotary cam formed with a V-shaped cut-out in each end and is rotatably mounted on one surface thereof. The stationary cylinder is provided at the inner wall surface thereof with a first projecting pawl for engaging in the cut-out at one end of the rotary cam so as to rotate the rotary cam by a small amount, and midway of the length thereof with a second projecting pawl for engaging in the cut-out at the other end of the rotary cam so as to further rotate the rotary cam by a small amount and fitting in the cut-out to retain the inserting portion in a state where the inserting portion is pushed in the hollow interior, and still further rotating the rotary cam to permit the inserting portion to pass when the inserting portion is pushed out of the hollow interior in the state where the rotary cam is perpendicular to the hollow interior.

However, the above-mentioned conventional latch device has such a shortcoming in that when the rotary cam rotates freely or reversely, poor engagement between both the cut-outs of the rotary cam and the first and second projections occurs, and the latch becomes unable to operate normally.

In order to prevent the free rotation and the reverse rotation of the rotary cam, it is possible to coat the rotary cam at the axially supporting portion thereof with a grease or the like so that the rotary cam will not rotate unexpectedly and/or to strictly maintain the size of the axially supporting portion so that rotation of the rotary cam will be restricted. However, these methods are causes for increasing the number of product inspection processes and the cost.

OBJECT AND SUMMARY OF THE INVENTION

Object of the Invention

A general object of the present invention is to provide a latch device which has a simple structure and yet is able to prevent a reverse rotation of a rotary cam without fail and to ensure a latching action.

Summary of the Invention

The present invention provides a latch device comprising a stationary cylinder, a sliding rod which is relatively movable with respect to the stationary cylinder, and a cam axially supported by one or the other of the stationary cylinder and the sliding rod, the other one of the stationary cylinder and the sliding rod being provided with a plurality of corresponding portions, the rotary cam being abutted against the corresponding portions and temporarily restricting the movement of the sliding rod while rotating in one direction towards the end of the relative reciprocal movement, the rotary cam being provided with means for preventing the reverse rotation of the rotary cam when the rotary cam is to rotate in the reverse direction during the relative reciprocal movement.

As described in the foregoing, according to the present invention, the rotary cam is provided with means for preventing its reverse rotation. As a result, the rotary cam is caused to rotate only in one direction by reciprocal movement of the sliding rod without fail, and thereby the sliding rod can be locked with respect to the stationary cylinder in the vicinity of one end portion of the reciprocal movement without fail.

Other objects and features of the present invention will become apparent from the following detailed description taken in conjunction with the accompanying drawings.

DETAILED DESCRIPTION OF THE PREFERRED EMBODIMENTS

The First Embodiment

Figure 1:
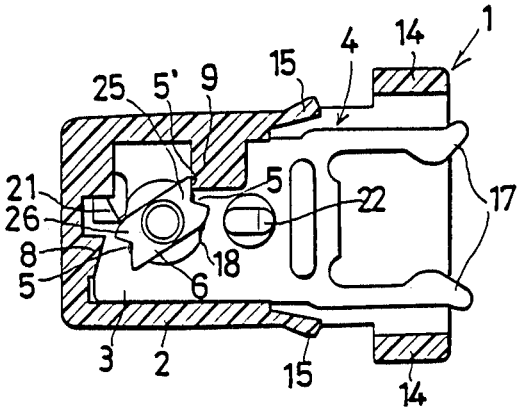
FIG. 1 is a sectional view of a latch device according to one embodiment of the present invention.
Figure 2:
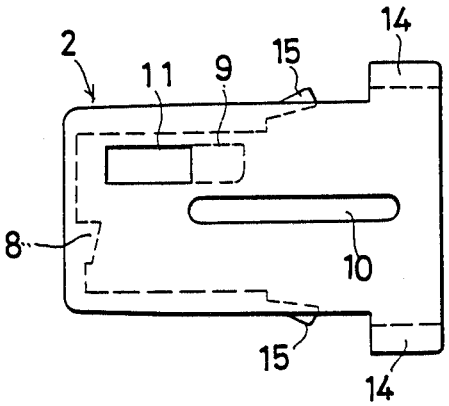
FIG. 2 is a plan view of a stationary cylinder of the latch device of FIG. 1.
Figure 3:
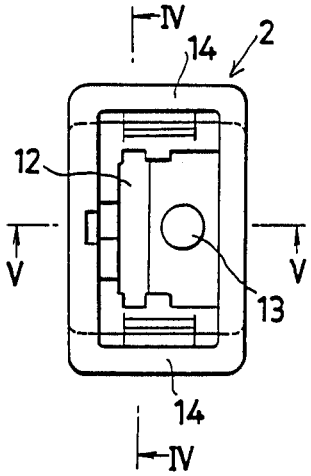
FIG. 3 is a right side view of the stationary cylinder.
Figure 4:
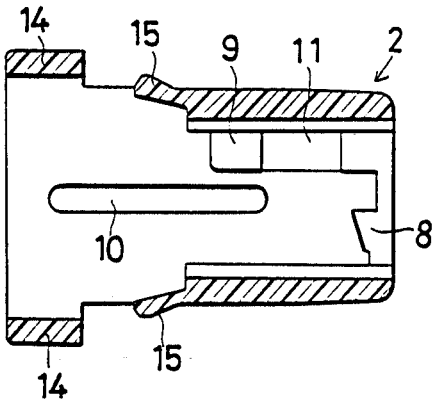
FIG. 4 is a sectional view taken along line IV—IV of FIG. 3.
Figure 5:
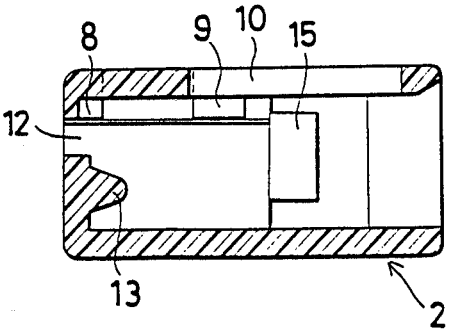
FIG. 5 is a sectional view taken along line V—V of FIG. 3.

A latch device according to a first embodiment of the present invention will be described with reference to FIGS. 1 through 18, in which reference numeral 1 generally denotes a latch device. The latch device 1 comprises a stationary cylinder 2 having a hollow interior, one end of which is closed and the other end of which is open, a sliding rod 4 having an inserting portion 3 which is slidable within the stationary cylinder 2, a rotary cam 6 rotatably mounted on the upper surface of the inserting portion 3 and having a V-shaped cut-out 5 at either end thereof, and a coil spring 7 which is biased between the stationary cylinder 2 and the inserting portion 3. The stationary cylinder 2, the sliding rod 4 and the rotary cam 6 are plastic moldings.

The stationary cylinder 2, as is shown in FIGS. 2 through 5, has a square cylindrical shape with one end open. The stationary cylinder 2 integrally includes at the inner area of the inner wall surface, which is in slide contact with the rotary cam 6, a first projecting pawl 8 having a generally acute angle for engaging in the cut-out 5 at one end of the rotary cam 6 in a state where the inserting portion 3 of the sliding rod 4 has been inserted the deepest into the hollow interior so as to rotate the rotary cam 6 by a small amount, and midway of the length thereof also integrally includes a second projecting pawl 9 having a right angle for engaging in the other cut-out 5 of the rotary cam in a state where the inserting portion 3 has been slightly pushed back from the innermost position so as to further rotate the rotary cam 6 by a small amount to fit in said other cut-out 5, and still further rotating the rotary cam 6 to permit the inserting portion 3 to pass when the inserting portion 3 is puhsed out of the hollow interior in the state where the rotary cam 6 is perpendicular to the hollow interior. The projecting pawls 8 and 9 are located opposite to each other within the hollow interior. Between the projecting pawls 8 and 9, a space is formed which is at least large enough to permit the rotary cam 6 to rotate.

In the upper wall of the stationary cylinder 2 are formed an elongated hole 10 extending in the longitudinal direction of the stationary cylinder 2 and adapted to restrict the slidable stroke of the inserting portion 3 with respect to the stationary cylinder 2, and an action confirming square window 11 open adjacent to the second projecting pawl 9. The stationary cylinder 2 is formed in the upper portion of the closed rear wall thereof with a lateral groove 12 for permitting the rear end 3' of the inserting portion 3 to fit therein and in the lower inner surface thereof with a boss 13 projecting therefrom and extending towards the opening portion. The boss 13 is provided with the coil spring 7 fitted therein at one end. In addition, the stationary cylinder 2 is provided at both ends of the opening portion with flange portions 14 extending sidewards therefrom, and at both side walls thereof with elastic retaining pieces 15 each comprising a U-shaped cut-out and projecting outwards towards the rear surface of the flange portion 14. The distance between the free end of the retaining piece 15 and the rear surface of the flange portion 14 is made to correspond to the thickness of the plate on which the latch device is to be mounted.

Figure 8:
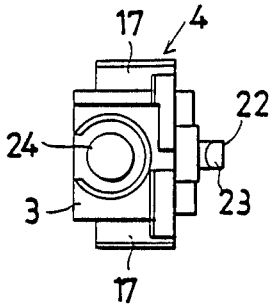
FIG. 8 is a left side view of the sliding rod.
Figure 6:
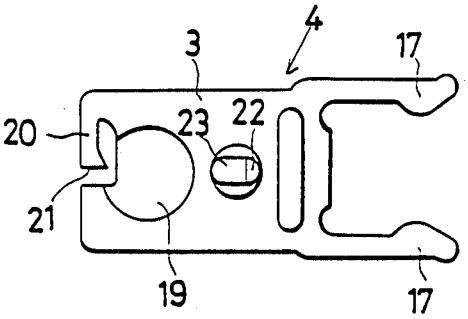
FIG. 6 is a plan view of a sliding rod of the latch device of FIG. 1.
Figure 7:
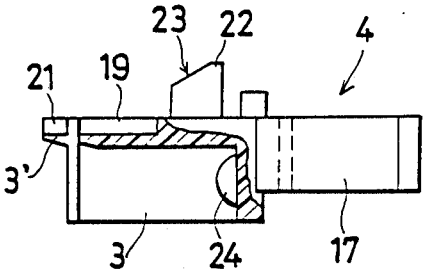
FIG. 7 is a front view, partly cut away, of the sliding rod.

The sliding rod 4, as is shown in FIGS. 6 through 8, is generally identical with the sectional configuration of the hollow interior of the stationary cylinder 2, except that it is integrally provided with the frame-like inserting portion 3 having an upper surface made thinner by an extent corresponding to the thickness of the rotary cam 6 and open lower and rear surfaces, and a pair of right and left holding pieces 17 separately projected from the front surface of the inserting portion 3 for holding a strike 16 therebetween. The inserting portion 3 is formed in the upper surface with a circular groove 19 for permitting a rotary shaft 18 for the rotary cam 6 to fit therein, and also with a laterally-extending elastic piece 20 formed by cutting out a part of the periphery of the groove 19. The elastic piece 20 is provided at the tip thereof with a retaining pawl 21 of saw tooth shape projecting towards the groove 19. Between the groove 19 and the holding piece 17, a circular column-shaped stopper 22 is provided projecting upwards therefrom and fitting in the elongated hole 10 of the stationary cylinder 2. The stopper 22 is provided at the projecting end thereof with a tapered surface 23 which is inclined downwardly to the rear. The inserting portion 3 is provided at the front inner wall surface thereof with a knob 24 having a dome shape projecting backwards therefrom. One end of the coil spring 7 is fitted over the knob 24, and the coil spring 7 is biased between the front inner wall surface of the inserting portion 3 and the rear inner wall surface of the stationary cylinder 2.

Figure 9:
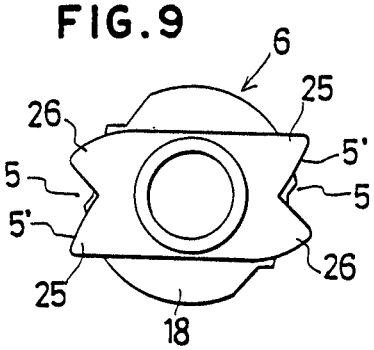
FIG. 9 is a plan view of a rotary cam of the latch device of FIG. 1.
Figure 10:
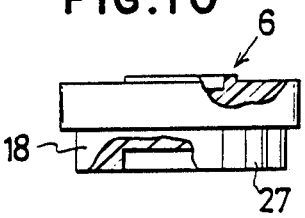
FIG. 10 is a front view, partly cut away, of the rotary cam.
Figure 11:
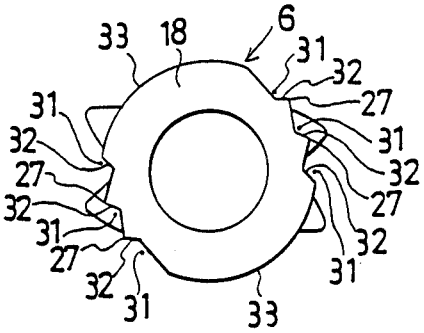
FIG. 11 is a bottom view of the rotary cam.

The rotary cam 6, as is shown in FIGS. 9 through 11, is provided at the center thereof with the rotary shaft 18 having a large diameter extending downwards for fitting in the groove 19 and in both ends thereof with the V-shaped cut-outs 5 which permit the projecting pawls 8 and 9 to engage therein. Angle portions 25 and 26 defining one of the cut-outs 5 are positioned diagonally relative to angle portions 25 and 26 defining the other cut-out 5, respectively. The angle portions 25 are acutely sharpened. The angle portions 26 are rounded like a sloping shoulder. Provided around the rotary shaft 18 are a plurality of ratchet teeth 27 for meshing with the retaining pawl 21.

In assembly, the rotary shaft 18 of the rotary cam 6 is first fitted in the groove 19 of the inserting portion 3 of the sliding rod 4 (see FIG. 12), the coil spring 7 is inserted into the hollow interior of the stationary cylinder 2 with one end of the coil spring 7 fitted over the boss 13 and the other end thereof fitted over the knob 24 of the inserting portion 3, and the inserting portion 3 is strongly pushed into the hollow interior of the stationary cylinder 2. When the inserting portion 3 is pushed therein, the taper surface 23 at the projecting end of the stopper 22 is brought to be in engagement with the periphery of the opening of the stationary cylinder 2, and pases through the opening while slightly widening the diameter thereof. Next, the projecting end of the stopper 22 is fitted into the elongated hole 10 of the stationary cylinder 2. In that state, the coil spring 7 is slightly depressed (see FIGS. 13 and 14).

Figure 15:
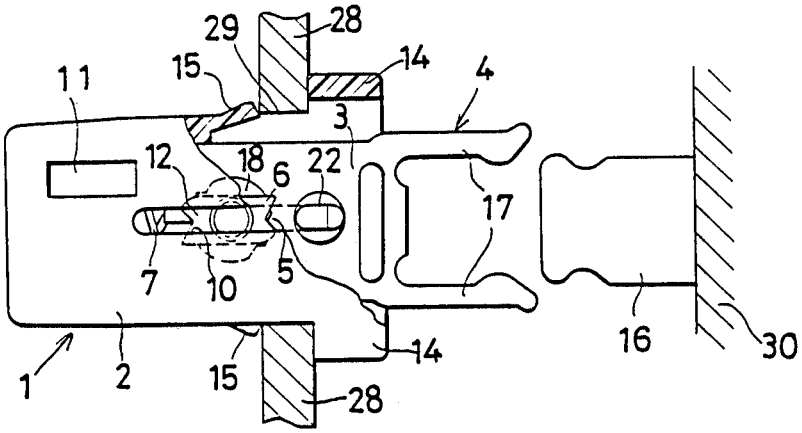
FIG. 15 is a partly sectional view showing the latch device mounted on a cabinet.
Figure 16:
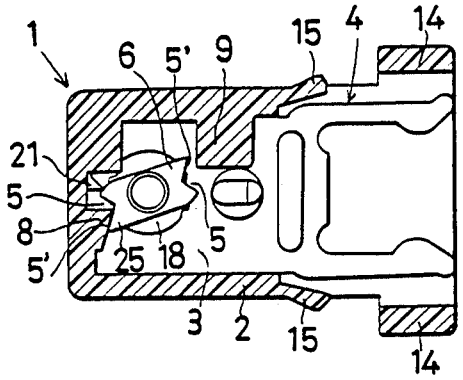
FIG. 16 is a schematic view showing the sliding rod pushed into the stationary cylinder of the latch device.

The so-assembled latch device 1 is secured to a mounting hole 29 of a stationary side panel 28 of a cabinet, etc., and a door 30 opposite thereto is provided at the rear surface thereof with the strike 16 projecting therefrom (see FIG. 15).

In order to shut the door 30, the door 30 may be simply pushed in towards the cabinet. When the door 30 has been pushed in, the strike 16 of the door 30 fits in the space between the pair of holding pieces 17, and the inserting portion 3 of the sliding rod 4 is pushed into the hollow interior of the stationary cylinder 2 by the strike 16. When the inserting portion 3 has been pushed in, the outer surface of the rotary cam 6 slide contacts with the second projecting pawl 9 and passes by the second projecting pawl 9 and, a little thereafter, the cut-out 5 at the head of the rotary cam 6 is brought in engagement with the first projecting pawl 8. Thereafter, one inner surface 5' of the cut-out 5 is pushed by the first projecting pawl 8 upon a small amount of pushing stroke for causing the rear end 3' of the inserting portion 3 to fit in the lateral groove 12 of the stationary cylinder 2. As a result, the rotary cam 6 is rotated counter-clockwise by a small amount (about 22.5 degrees) about the rotary shaft 18 (see FIG. 18). In that state, when pushing of the door 30 has been stopped, the inserting portion 3 is pushed back, by the restoring force of the coil spring 7, the cut-out 5 at the tail of the rotary cam 6, which has been rotated by a small amount during the pushing-back stroke, is brought in engagement with the second projecting pawl 9. As a result, said one inner surface 5' of the cut-out 5 is pushed by the second projecting pawl 9 during the pushing-back stroke of the inserting portion 3 to cause the rotary cam 6 to further rotate counter-clockwise by a small amount (about 22.5 degrees) about the rotary shaft 18. When the rotary cam 6 has rotated by about 45 degrees, the sharp angle portion 25 of the rotary cam 6 is caught by the inner surface of the second projecting pawl 9. As a result, the inserting portion 3 is locked in a state where it is pushed into the hollow interior of the stationary cylinder 2 (see FIG. 1). Accordingly, the door 30 is locked in the shut state at that position.

Figure 17:
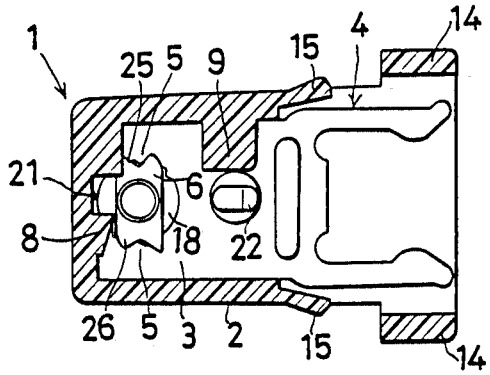
FIG. 17 is a schematic view for explaining how the engagement of the rotary cam is canceled by pushing in the sliding rod of the latch device again.
Figure 18:
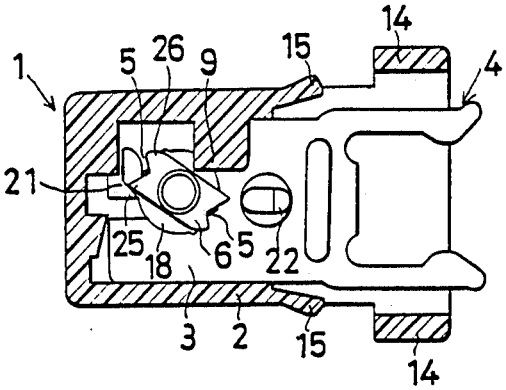
FIG. 18 is a schematic view showing a state where the rotary cam of the latch device has rotated clockwise.
Figure 19:
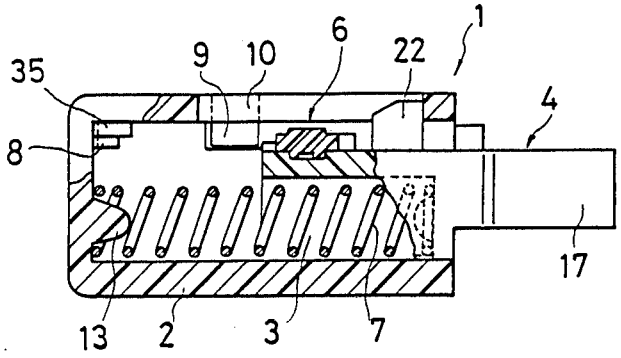
FIG. 19 is a front view, partly in section, of a latch device according to another embodiment of the present invention.

In order to open the door 30, the door 30 need only to be pushed in towards the cabinet. When the door 30 has been pushed in, the outer surface of the sloping shoulder-shaped angle portion 26 at the head of the rotary cam 6 which has been rotated by about 45 degrees is pushed by the first projecting pawl 8 to be further rotated by about 45 degrees and is brought to be perpendicular to the hollow interior of the stationary cylinder 2 (FIG. 17). When at this time pushing of the door 3 is stopped, the inserting portion 3 is pushed back, by the restoring force of the coil spring 7. As a result, the outer surface of the sloping shoulder-shaped angle portion 26 at the tail of the rotary cam 6 is pushed by the second projecting pawl 9 to further rotate counter-clockwise by about 90 degrees to pass by the second projecting pawl 9, and is pushed back until the stopper 22 of the inserting portion 3 hits the end portion of the elongated hole 10 of the stationary cylinder 2 (see FIGS. 13 and 18). Accordingly, the door 30 is pushed opened by a small amount when the inserting portion 3 is pushed back, and when the door 30 has slightly opened, it can be fully opened by hand. As a result, the strike 16 at the rear surface of the door 30 is released from between the holding pieces 17 of the latch device 1.

Figure 12:
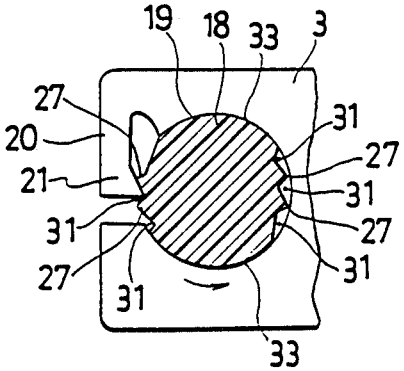
FIG. 12 is a partly sectional view showing the meshing state between the teeth of a ratchet wheel of the latch device and the pawl of a retaining pawl.
Figure 13:
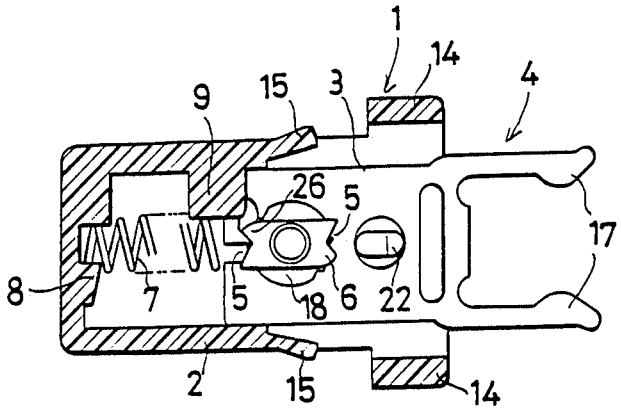
FIG. 13 is a plan view in section of the latch device of FIG. 1.
Figure 14:
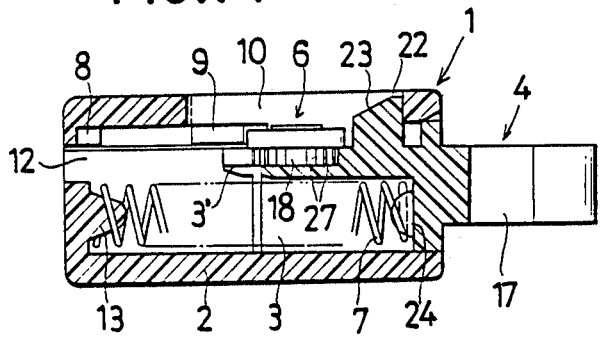
FIG. 14 is a sectional view of the latch device of FIG. 1.

On the other hand, upon rotation of the rotary cam 6, one of the ratchet teeth 27 mounted on the rotary shaft 18 meshes with the retaining pawl 21, thereby preventing a reverse rotation of the rotary shaft 18 (see FIG. 12). The ratchet teeth 27 may be provided around the entire periphery of the rotary shaft 18. In this embodiment, however, a pair of ratchet teeth 27 are provided at either side of the rotary shaft 18, and three valleys 31 are formed by each pair of ratchet teeth 27. The central angle between the adjacent valleys 31 is set to be about 22.5 degrees, which is equal to the angle of rotation when the rotary cam 6 rotates together with the projecting pawls 8 and 9 engaged with the rotary cam 6. Accordingly, when the rotary cam 6 is in alignment with the sliding direction of the inserting portion 3, the retaining pawl 21 is fitted in the leading valley 31 in the rotating direction. Similarly, when the rotary cam 6 is engaged with the second projecting pawl 9 and rotated counter-clockwise by a small amount, the elastic piece 20 is flexed thereby to permit the retaining pawl 21 to climb over the leading ratchet tooth 27 and to fit into the next valley 31. Then, the retaining pawl 21 is fitted into the trailing valley 31 when the rotary cam 6 has been engaged with the second projecting pawl 9 and further rotated counter-clockwise by a small amount. In this way, since the retaining pawl 21 fits into the respective valleys 31 according to the angle of rotation of the rotary cam 6, the rotation of the rotary cam 6 produces click sensation. In addition, since free rotation and reverse rotation of the rotary cam 6 can be prevented, no error will arise in the engaging positions between the rotary cam 6 and the respective projecting pawls 8 and 9. Thus, a sure action can be obtained.

In this embodiment, since the gradient of the inclined surface 32 between each ratchet tooth 27 and the following valley 31 is made sharp, a click sound of operation is generated when the retaining pawl 21 falls into the following valley 31 after climbing over the ratchet tooth 27. Of course, this operating sound can be eliminated by making the gradient of the inclined surface 32 gentle. In this way, the operating sound may or may not be produced according to use.

Furthermore, on a portion of the outer periphery of the rotary shaft 18 where no ratchet tooth 27 is provided, a braking function of the rotary shaft 18 is also obtained since the retaining pawl 21 is always held in slide contact with this periphery by the elastic force of the elastic piece 20. In addition, there is the advantage that, since no ratchet teeth 27 are provided at some portions of the outer periphery, the force required to rotate the rotary cam 6 is proportionally reduced.

The Second Embodiment

In the first embodiment, a reverse rotation of the rotary cam is prevented by providing ratchet teeth on the rotary shaft of the rotary cam. Next, with reference to FIGS. 19 through 24, there will be described a latch device in which the rotary cam is provided with means for abutting with the stationary cylinder in order to prevent a reverse rotation of the rotary cam. As in the first embodiment, the latch device 1 comprises a stationary cylinder 2, a sliding rod 4 having an inserting portion 3, a rotary cam 6 having a V-shaped cut-out 5 on each end thereof, and a coil spring 7 compressed between the stationary cylinder 2 and the inserting portion 3.

Figure 20:
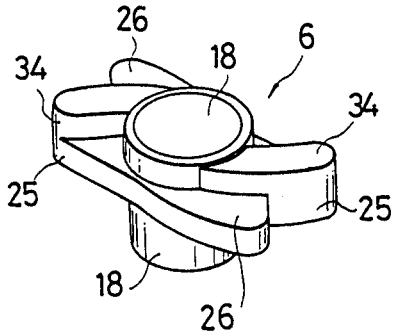
FIG. 20 is a perspective view of a rotary cam of FIG. 19.
Figure 21:
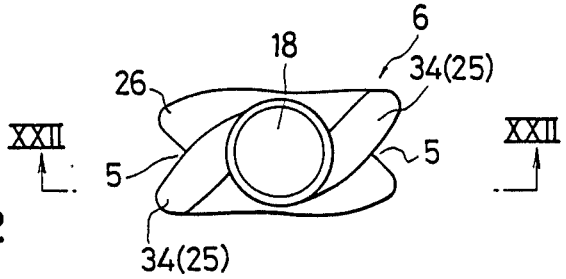
FIG. 21 is a plan view of the rotary cam.
Figure 22:
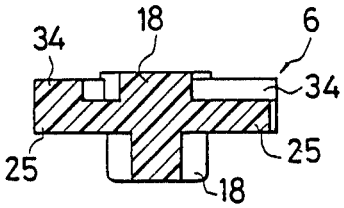
FIG. 22 is a sectional view taken along line XXII—XXII of FIG. 21.

The rotary cam 6, as is shown in FIGS. 20 through 22, is provided at the center thereof with a rotary shaft 18 extending in the vertical direction and in each end thereof with a V-shaped cut-out 5 for engaging with first and second projecting pawls 8 and 9 of the stationary cylinder 2. A pair of ribs 34 extends from the upper portion of the rotary shaft 18 of the rotary cam 6 towards angle portions 25 at both ends. The leading end portion of each rib 34 and a portion of the rib in the vicinity of the leading end portion are formed in the same shape as the angle portion 25.

Figure 23:
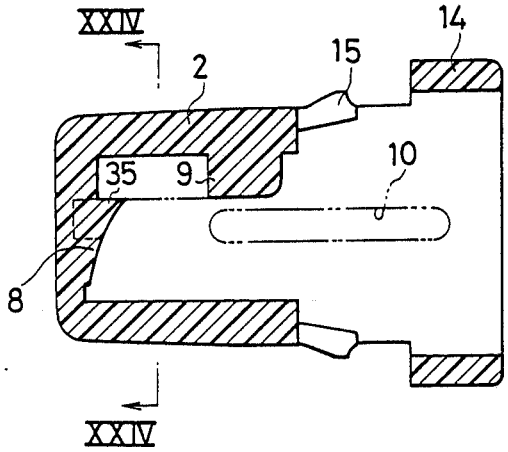
FIG. 23 is a sectional view of a stationary cylinder of the latch device of FIG. 19.
Figure 24:
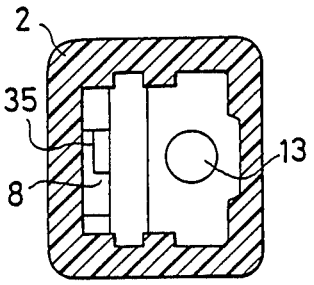
FIG. 24 is a sectional view taken along line XXIV—XXIV of FIG. 23.
Figure 25:
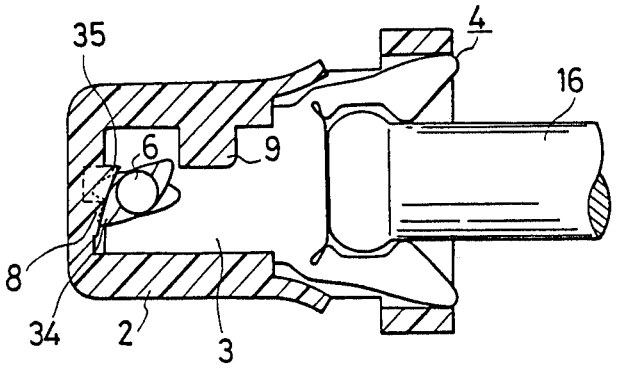
FIG. 25 is a schematic view of a sliding rod pushed into the stationary cylinder of the latch device of FIG. 19.

At the position inside of the stationary cylinder 2 corresponding to the above-mentioned ribs 34, there is formed the first projecting pawl 8 on which a projection 35 is formed. The projection 35, as is shown in FIG. 23, is formed with an inclined surface which forms an extending surface of the first projecting pawl 8.

With the above-described construction, when the inserting portion 3 of the sliding rod 4 is pushed in the hollow interior of the stationary cylinder 2 by a strike 16, the outer surface of the rotary cam 6 is slide contacted with the second projecting pawl 9 and passes by the second projecting pawl 9. A little thereafter, the cut-out 5 at the head of the rotary cam 6 is brought in engagement with the first projecting pawl 8. At this time, the rotary cam 6 may sometimes be rotated clockwise by vibration or the like. This tends to prevent the cut-out 5 at the head from engaging with the first projecting pawl 8. According to the present invention, however, even in such a case, the rib 24 at the head thereof is guided to the inclined surface of the projection 35, and the trailing cut-out 5 is rotated towards the engaging portion of the projecting pawl 9. Accordingly, when pushing of the strike 16 has been stopped in that state, the inserting portion 3 will be pushed back by the restoring force of the coil spring 7, and the trailing cut-out 5 of the rotary cam 6 will be brought in engagement with the projecting pawl 9 without fail. Thus, an unexpected rotation of the rotary cam 6 is prevented, and thereafter the latch operation can be continued.

As described in the foregoing, according to the present invention, since reverse rotation preventing means is provided for preventing a rotary cam from rotating reversely during a relative reciprocal movement of the rotary cam, free rotation and reverse rotation of the rotary cam can be prevented without fail so that no-error will arise in the engaging positions between the cut-outs of the rotary cam and the projecting pawls, thus ensuring reliable operation. Thus, a highly reliable latch can be obtained. In addition, since no coating with grease is required in order to obtain a braking function, there can be obtained a latch which is easy to assemble and inexpensive to manufacture.

What is claimed is:

1. A latch device comprising:

(a) a stationary cylinder having a hollow interior with one end thereof open;

(b) a sliding rod having an inserting portion sized, shaped, and positioned to slide within said stationary cylinder;

(c) spring means sized, shaped, and positioned so that it is compressed when said insert portion is inserted into said stationary cylinder;

(d) a rotary cam having a V-shaped cut-out in each end thereof and rotatably mounted on one surface of said inserting portion;

(e) a first projecting pawl provided at the inner side of an inner wall surface of said stationary cylinder, said first projecting pawl being sized, shaped, and positioned to engage in the cut-out at one end of said rotary cam so as to rotate said rotary cam by a small amount;

(f) a second projecting pawl provided midway of the length of said stationary cylinder, said second projecting pawl being sized, shaped, and positioned to engage in the cut-out at the other end of said rotary cam so as to further rotate said rotary cam by a small amount and, fitting in the cut-out, to retain said inserting portion in a state where said inserting portion is pushed in said hollow interior, and after further rotation of said rotary cam, to permit said inserting portion to pass when said inserting portion is pushed out of said hollow interior in the state where said rotary cam is perpendicular to said hollow interior;

(g) at least one ratchet tooth provided on the periphery of a rotary shaft of said rotary cam; and (h) a retaining pawl provided on a bearing portion for said rotary shaft and adapted to mesh with said at least one ratchet tooth.

2. A lock device comprising:

(a) a stationary cylinder having a hollow interior with one end thereof open;

(b) a sliding rod having an inserting portion sized, shaped, and positioned to slide within said stationary cylinder;

(c) spring means sized, shaped, and positioned so that it is compressed when said insert portion is inserted into said stationary cylinder;

(d) a rotary cam having a V-shaped cut-out in each end thereof and rotatably mounted on one surface of said inserting portion;

(e) a first projecting pawl provided at the inner side of an inner wall surface of said stationary cylinder, said first projecting pawl being sized, shaped, and positioned to engage in the cut-out at one end of said rotary cam so as to rotate said rotary cam by a small amount;

(f) a second projecting pawl provided midway of the length of said stationary cylinder, said second projecting pawl being sized shaped, and positioned to engage in the cut-out at the other end of said rotary cam so as to further rotate said rotary cam by a small amount and, fitting in the cut-out, to retain said inserting portion in a state where said inserting portion is pushed in said hollow interior, and, after further rotation of said rotary cam, to permit said inserting portion to pass when said inserting portion is pushed out of said hollow interior in the state where said rotary cam is perpendicular to said hollow interior; and (g) abutting means provided between said rotary cam and said stationary cylinder and adapted to prevent a reverse rotation of said rotary cam during the relative reciprocal movement between said stationary cylinder and said sliding rod.

3. A lock device as claimed in claim 2, wherein said abutting means comprises:

(a) a pair of ribs provided on said rotary cam and (b) a projection having an inclined surface within said stationary cylinder.

4. A latch device comprising:

(a) a stationary cylinder having a hollow interior with one end thereof open;

(b) a sliding rod comprising a pair of holding pieces and an inserting portion, said inserting portion having a structure slidably within said hollow interior of said stationary cylinder;

(c) spring means disposed within said hollow interior of said statinary cylinder for biasing said inserting portion of said sliding rod;

(d) a rotary cam having a V-shaped cut-out in each end thereof and rotatably mounted on one surface of said inserting portion;

(e) a first projecting pawl provided at the inner side of an inner wall surface of said stationary cylinder for engaging in the cut-out at one end of said rotary cam so as to rotate said rotary cam by a small amount;

(f) a second projecting pawl provided midway of the length of said stationary cylinder for engaging in the cut-out at the other end of said rotary cam so as to further rotate said rotary cam by a small amount and fitting in the cut-out to retain said inserting portion in a state where said inserting portion is pushed in said hollow interior, and still further rotating said rotary cam to permit said inserting portion to pass when said inserting portion is pushed out of said hollow interior in the state where said rotary cam is perpendicular to said hollow interior;

(g) at least one ratchet tooth provided on the periphery of a rotary shaft of said rotary cam; and (h) a retaining pawl provided on a bearing portion for said rotary shaft and adapted to mesh with said at least one ratchet tooth.

5. A latch device comprising:

(a) a stationary cylinder having a hollow interior with one end thereof open;

(b) a sliding rod comprising a pair of holding pieces and an inserting portion, said inserting portion having a structure slidable within said hollow interior of said stationary cylinder;

(c) spring means disposed within said hollow interior of said stationary cylinder for biasing said inserting portion of said sliding rod;

(d) a rotary cam having a V-shaped cut-out in each end thereof and rotatably mounted on one surface of said inserting portion;

(e) a first projecting pawl provided at the inner side of an inner wall suface of said stationary cylinder for engaging in the cut-out at one end of said rotary cam so as to rotate said rotary cam by a small amount;

(f) a second projecting pawl provided midway of the length of said stationary cylinder for engaging in the cut-out at the other end of said rotary cam so as to further rotate said rotary cam by a small amount and fitting in the cut-out to retain said inserting portion in a state where said inserting portion is pushed in said hollow interior, and still further rotating said rotary cam to permit said inserting portion to pass when said inserting portion is pushed out of said hollow interior in the state where said rotary cam is perpendicular to said hollow interior; and (g) abutting means provided between said rotary cam and said stationary cylinder and adapted to prevent a reverse rotation of said rotary cam during the relative reciprocal movement between said stationary cylinder and said sliding rod.

6. A lock device as claimed in claim 5, wherein said abutting means comprises:

(a) a pair of ribs provided on said rotary cam and (b) a projection having an inclined surface within said stationary cylinder.

* * * * *

UNITED STATES PATENT AND TRADEMARK OFFICE

CERTIFICATE OF CORRECTION

PATENT NO. : 4,779,906

DATED : Oct. 25, 1988

INVENTOR(S) : Mutsuo KURASAKI et al.

It is certified that error appears in the above-identified patent and that said Letters Patent is hereby corrected as shown below: On the Title Page, Item [75]:

The second inventor's name has been omitted; please add as follows:

-- Yoshio Kaneko, Yokohama, Japan --

Signed and Sealed this

Twenty-eighth Day of March, 1989

*Attest:*

DONALD J. QUIGG

*Attesting Officer*

*Commissioner of Patents and Trademarks*